US005863470A

United States Patent [19]

Grant

[11] Patent Number: 5,863,470

[45] Date of Patent: Jan. 26, 1999

[54] CARBURETOR WITH A REPLACEABLE VENTURI SLEEVES

[76] Inventor: Barry Grant, 1450 McDonald Rd., Dahlonega, Ga. 30533

[21] Appl. No.: 801,721

[22] Filed: Feb. 14, 1997

Related U.S. Application Data

[60] Provisional application No. 60/011,550 Feb. 13, 1996.

[51] Int. Cl. [6] ..... F02M 9/14; F02M 19/10

[52] U.S. Cl. ..... 261/23.2; 261/34.1; 261/78.1; 261/DIG. 12; 261/DIG. 39; 261/DIG. 56

[58] Field of Search ..... 261/34.1, 23.2, 261/78.1, DIG. 39, DIG. 56, DIG. 12

[56] References Cited

U.S. PATENT DOCUMENTS

| | | | |
|---|---|---|---|
| 4,235,828 | 11/1980 | Howes | 261/78.1 |
| 4,250,856 | 2/1981 | Abbey | 261/DIG. 56 |
| 4,387,685 | 6/1983 | Abbey | 261/23.2 X |
| 4,808,007 | 2/1989 | King | 261/78.1 X |
| 4,966,735 | 10/1990 | Lo Russo | 261/78.1 X |
| 5,667,730 | 9/1997 | Barfield | 261/23.2 X |

FOREIGN PATENT DOCUMENTS

| | | | |
|---|---|---|---|
| 1008052 | 5/1957 | Germany | 261/23.2 |
| 63-9665 | 1/1988 | Japan | 261/DIG. 12 |

OTHER PUBLICATIONS

HP Books, Weber Carburetors Pat Braden, 3 pages, 1988.

HP Books, Weber Carburetors; Pat Braden; 3 pages; 1988.

Performance Racing Industry Magazine; p. 28; Twisted Wedge Aluminum Cylinder Heads for 289, 302, or 351 W made by Trick Flow, undated.

*Primary Examiner*—Richard L. Chiesa

*Attorney, Agent, or Firm*—Thomas, Kayden, Horstemeyer & Risley

[57] ABSTRACT

Venturi sleeves (24, 26, 28 and 30) are telescopically moved upwardly into the bores (14, 16, 18 and 20) of the carburetor body (12) until the annular shoulder (46) of each sleeve abuts a corresponding shoulder (36) of each bore. Booster venturis (74, 76, 78 and 80) are suspended coaxially with respect to the venturi sleeves (24–30) with the support conduit (86) extending through a notch (52) at the first edge of the venturi sleeve. Positioning cords (50) are formed in the lower outer cylindrical surface (44) of each venturi sleeve (24), so that the positioning cords (50) must face and abut each other when the venturi sleeves are properly inserted into the bores of the carburetor body, thus assuring that the sleeves are properly oriented in the carburetor body. Flow director surfaces (104, 106, 108 and 110) in the carburetor bowl (102) guide the air toward the venturi sleeves.

19 Claims, 5 Drawing Sheets

CARBURETOR WITH A REPLACEABLE VENTURI SLEEVES

CROSS REFERENCE TO RELATED APPLICATION

This application claims the benefit of U.S. provisional application Ser. No. 60/011,550 filed Feb. 13, 1996.

FIELD OF THE INVENTION

This invention relates to carburetors for internal combustion engines for high performance vehicles. More particularly, the invention relates to a carburetor having interchangeable and replaceable parts, including replaceable venturi sleeves useable in a basic carburetor structure for adapting a carburetor to various air quantities required for engines of different capacities. Also, the invention relates to a carburetor having a contoured flow director surface in the carburetor bowl for smoothly directing air toward the venturi throats.

BACKGROUND OF THE INVENTION

Carburetors for high performance internal combustion engines used for racing vehicles usually are of high capacity and are relatively expensive. The carburetors as well as many other parts and components of a racing vehicle are subject to being changed so as to modify the performance of the vehicle. In some instances, a carburetor must be changed in response to the change of or modification to an engine of the vehicle. In other instances, the capacity of the carburetor must be modified, as by changing out the carburetor, to achieve maximum engine performance. Most carburetors are produced by casting which usually does not create a precision shape and it becomes cost prohibitive to machine the critical surfaces of a cast venturi in order to modify the performance characteristics of the venturi. Therefore, it would be desirable to be able to expediently modify the shape and other features of venturi surfaces of a carburetor by replacing one venturi surface with another venturi surface.

SUMMARY OF THE INVENTION

Briefly described, the present invention comprises a carburetor for an internal combustion engine for high performance vehicles which has replaceable parts, such as replaceable venturi sleeves which are positioned in the barrels of the carburetor. Replaceable venturi sleeves of different size, shape and capacity, which are not manufactured by casting but which are machined billets, can be more easily formed to the desired shape and inserted in the basic carburetor body, which changes the capacity of the carburetor to pass air therethrough. Having a machined venturi sleeve that is interchangeable with other machined venturi sleeves is a cost effective way to have precisely shaped venturi surfaces in a standard carburetor body. The venturi sleeves are formed so as to seat in a predetermined position within its receptacle of the carburetor body, and a base plate attaches to the carburetor body behind the sleeves, holding the sleeves in their set positions. With this arrangement, a standard carburetor body can be supplied with venturi sleeves of different shapes.

In the preferred embodiment, the sleeves each include a side opening for the passage into the sleeve of the support conduit of a booster venturi. The booster venturi is removably attached to the carburetor body, by mounting one end of the support conduit of the booster venturi to the carburetor body and extending the support conduit downwardly through the side opening of the venturi sleeve, and a ring nozzle is attached to the support conduit, and is suspended by the support conduit concentrically in the venturi sleeve.

Each venturi sleeve includes an upper outer cylindrical surface sized and shaped to match the size and shape of the upper cylindrical portion of the bore of the carburetor body, and a lower outer cylindrical surface larger than the upper outer cylindrical surface, which is sized and shaped to match the size and shape of the lower cylindrical portion of the carburetor bore. An external annular shoulder joins the upper and lower outer cylindrical surfaces of the venturi sleeve, and the shoulder of the venturi sleeve is sized and positioned so as to abut a complementary shoulder formed in the open ended bore of the carburetor body, so as to accurately position the venturi sleeve at the correct height in the carburetor body.

Additionally, the larger lower outer cylindrical surface of the venturi sleeve has a positioning cord formed thereon which is opposite to the side opening in the venturi sleeve.

The positioning cord of one venturi sleeve engages against and is complimentary with respect to a similar flattened cord of an adjacent venturi sleeve, so that the flattened cord of adjacent venturi sleeves function as positioning cords, angularly orienting the venturi sleeves in the carburetor body.

The bores of the carburetor body intersect the bowl of the carburetor, so that the venturi sleeves which are telescopically received in the bores are in open communication with the carburetor bowl. The carburetor bowl is shaped to provide flow director surfaces that surround each bore and venturi sleeve, so as to direct the air flow into the venturi sleeves.

In the embodiment disclosed, the flow director surfaces are generally concave and slope downwardly in the carburetor bowl toward and intersect the bores of the carburetor body, and therefore intersect the upper edges of the venturi sleeves. The flow director surfaces leading to the venturi sleeves are contoured and angled so as to be coextensive with the inwardly converging annular contoured surface of the venturi sleeves, providing an unobstructed smooth transition from the carburetor bowl into the throat of the venturi, tending to reduce any obstruction to air flow from the carburetor bowl to the venturi throat.

Although contoured concave flow director surfaces are disclosed, other shapes of flow director surfaces can be used, such as fins, grooves, vanes, convex surfaces, flats and angles, all of which might be used to smoothly direct the flow of air to the venturi throat with as little turbulence and change of direction as practical. Preferably, the flow director surfaces of these structures adjacent the inlet of the venturi throat are contoured and are coextensive with the inwardly converging annular venturi surfaces of the venturi throat so as to minimize any obstruction to air flow into the venturi throat and to reduce the amount of change of direction of the air as it approaches and enters the venturi throat, thereby improving the flow of air about the inlet of the venturi throat.

Thus, it is an object of this invention to provide an improved carburetor for high performance internal combustion engines which has replaceable parts for providing changes in performance of the carburetor, and therefore of the engine.

Another object of this invention is to provide a cast carburetor having interchangeable machined venturi sleeves of different internal shape, whereby certain sleeves can be used for certain performance of the carburetor and its engine.

Another object of this invention is to provide replaceable venturi sleeves for a carburetor body which are shaped and sized so as to become aligned with the bores of the carburetor body, and which may be inserted in the carburetor body to change the performance capacity of the carburetor.

Another object of the invention is to provide an improved carburetor that has flow director surfaces in its bowl, with the flow director surfaces adjacent the carburetor venturi throat being contoured and coextensive with the inwardly converging annular venturi surfaces of the venturi throat to reduce the turbulence of air passing from the carburetor bowl to the venturi throat.

Another object of the invention is to provide a carburetor having improved flow of air about the inlet of the venturi throat, and improved performance, and which can be modified by substitution of parts to change its performance.

Other objects, features and advantages of the present invention will become apparent upon reading the following specification, when taken in conjunction with the accompanying drawings.

DETAILED DESCRIPTION

Figure 1:
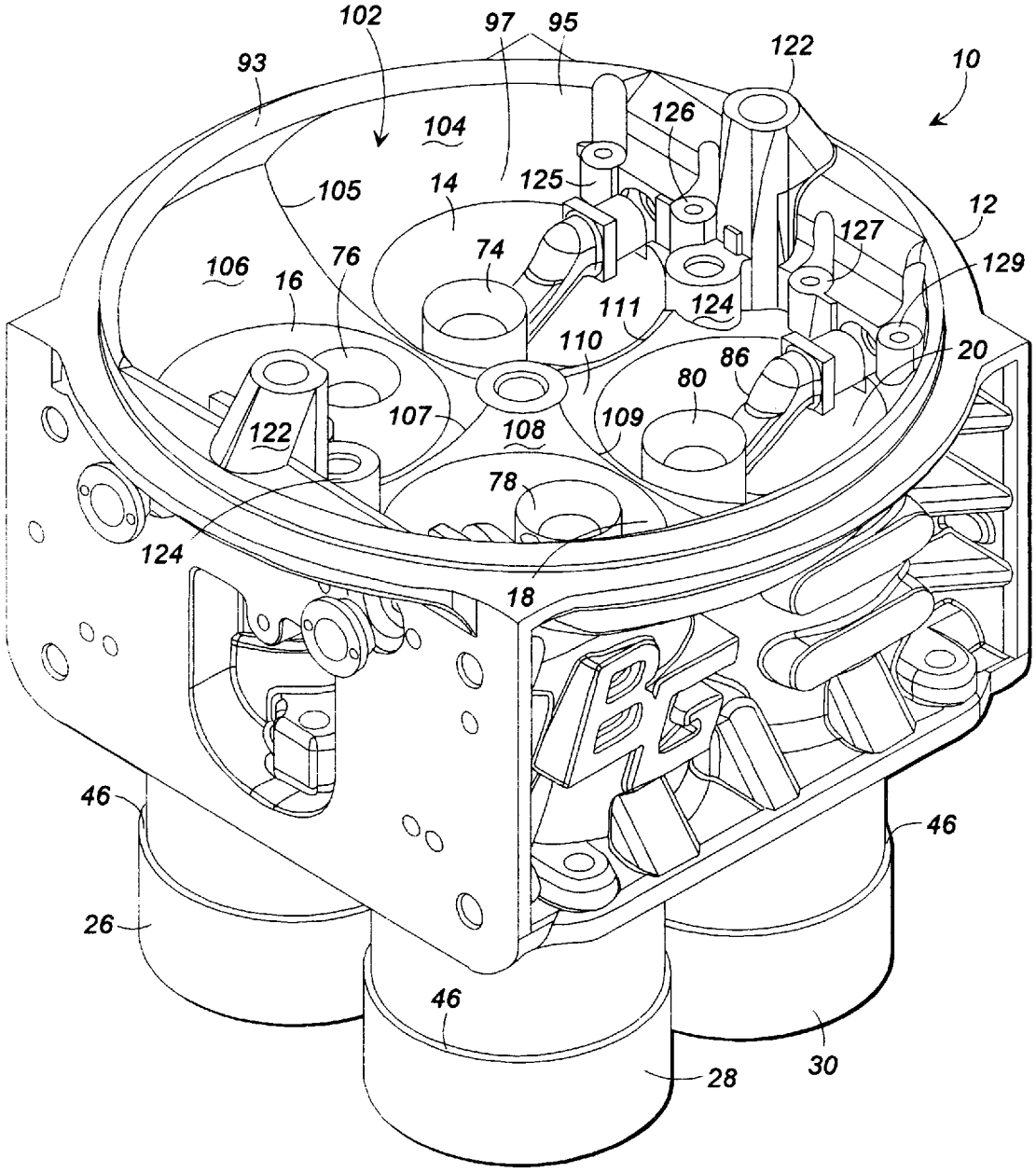
FIG. 1 is a perspective illustration of a carburetor body embodying the disclosed invention, with the venturi sleeves and booster venturis installed in the carburetor body.
Figure 2:
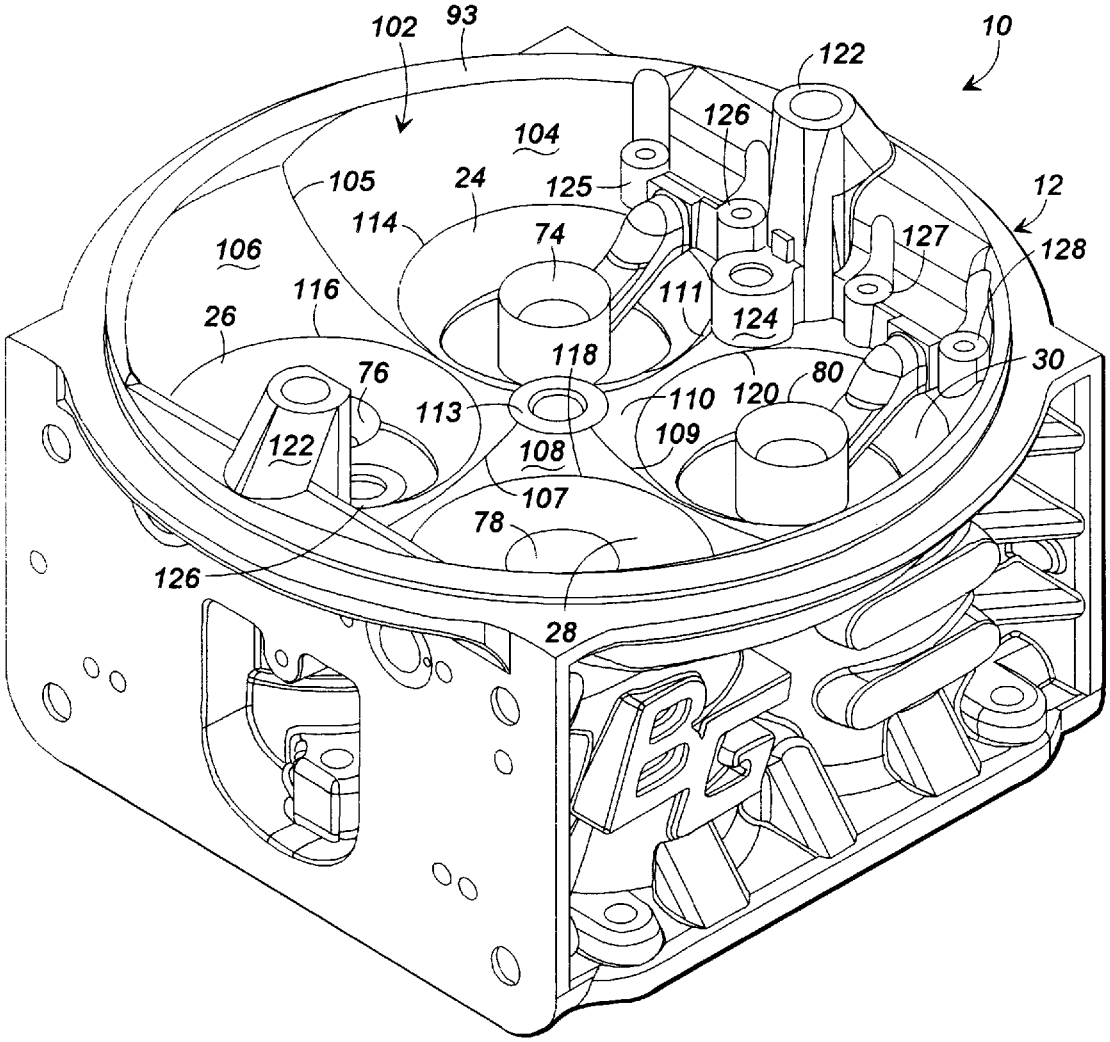
FIG. 2 is a perspective illustration of a carburetor body, similar to FIG. 1, but showing the venturi sleeves and the booster venturis displaced from their installed positions.

Referring now in more detail to the drawings, in which like numerals indicate like parts throughout the several views, FIGS. 1 and 2 illustrate the carburetor 10 which includes a cast carburetor body 12, with the body 12 defining four barrels or bores 14, 16, 18 and 20 (FIG. 2), arranged in a rectangular cluster, which function to pass atmospheric air or other gases to an internal combustion engine (not shown). Machined venturi sleeves 24, 26, 28 and 30 are telescopically received in the bores 14–20, respectively (FIG. 1).

Figure 4:
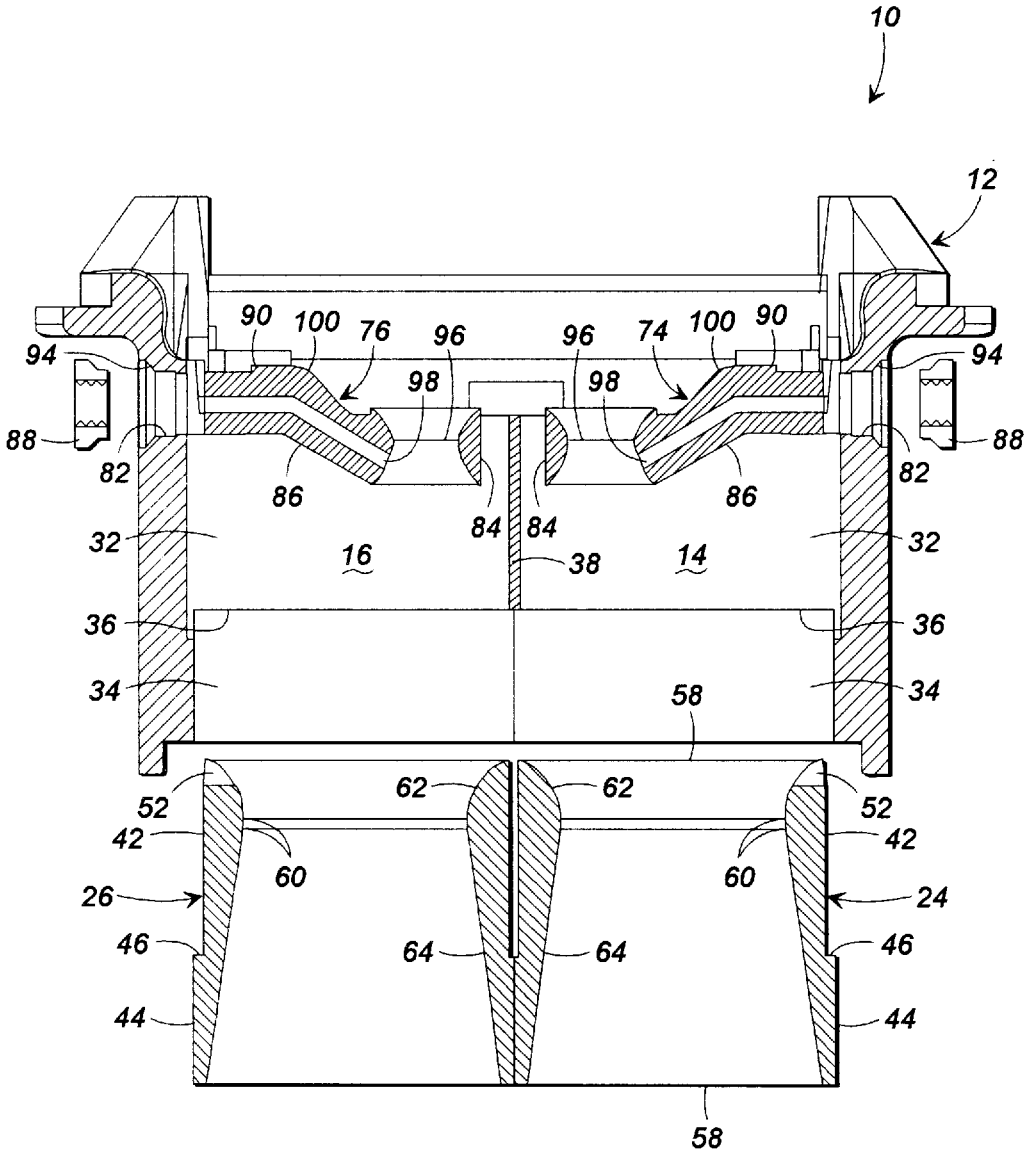
FIG. 4 is a side cross-sectional view, similar to FIG. 3, but showing the venturi sleeves and the booster venturis displaced from their installed positions.

The bores 14–20, such as the bores 14 and 16 in FIG. 4, include an upper cylindrical interior portion 32 and a lower cylindrical interior portion 34, and an annular internal shoulder 36 joining said upper and lower cylindrical interior portions. The lower cylindrical interior portion 34 of bores 14 and 20 intersect lower cylindrical interior portion 34 of bores 16 and 18. Partition 38 separates the upper cylindrical interior portions 32 of bores 14 and 16 (as shown in FIG. 4) and of bores 18 and 20.

Venturi sleeves, such as the sleeves 24 and 26 of FIG. 4, are telescopically inserted into the bores of the carburetor body. Each venturi sleeve is positioned in a bore, and the venturi sleeves each have an upper outer cylindrical surface 42 which is sized and shaped to match the size and shape of the upper cylindrical interior portion 32 of a bore, and a lower outer cylindrical surface 44 sized and shaped to match the size and shape of the lower cylindrical interior portion 34 of the bores. An external shoulder 46 is formed on the external surface of each venturi sleeve, with the external shoulder joining the upper and lower outer cylindrical surfaces of the venturi sleeve.

Figure 3:
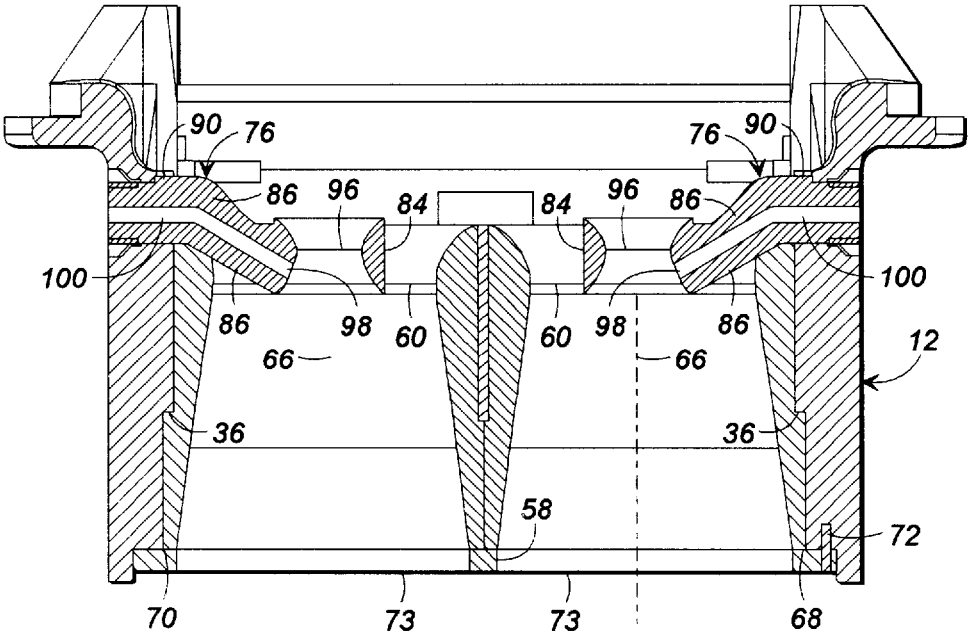
FIG. 3 is a side cross-sectional view of the carburetor body, with the venturi sleeves and booster venturis installed.

With the arrangement described above and illustrated in FIGS. 3 and 4, the venturi sleeves 24–30 can be moved longitudinally into the bores 14–20, with the outer cylindrical surfaces 42 and 44 being telescopically received in the cylindrical interior portions 32 and 34 of the bores of the carburetor, until the external shoulder 46 of each venturi sleeve engages the internal shoulder 36 of its bore. This fixes the longitudinal position of each venturi sleeve in its bore.

Figure 5A:
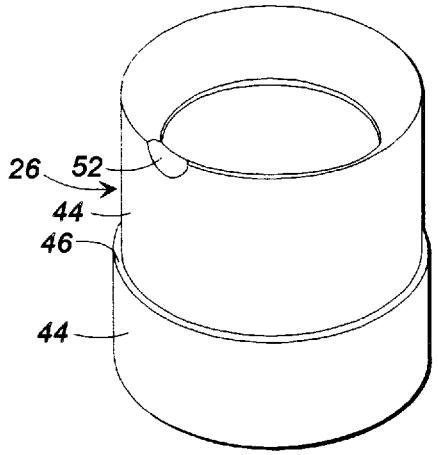
FIGS. 5*a* and 5*b* are perspective illustrations of adjacent ones of the venturi sleeves, displaced from one another so as to reveal the positioning cord of one of the sleeves.
Figure 5B:
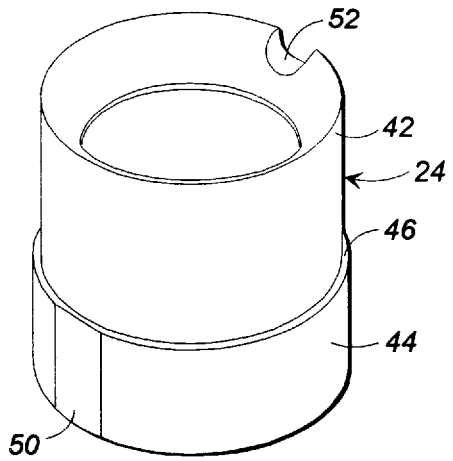

As illustrated in FIGS. 5*a* and 5*b*, each venturi sleeve, such as sleeves 24 and 26, includes a positioning cord 50 which is formed in the lower outer cylindrical surface 44 of the venturi sleeve, with the positioning cord extending the full length of lower outer cylindrical surface 44. Diagonally across from the positioning cord 50 is an opening in the shape of a slot 52 which is sized and shaped to receive the support conduit of a booster venturi, which will be described in more detail hereinafter. With this arrangement, the venturi sleeves, such as sleeves 24 and 26, are placed closely adjacent one another so that the positioning cords 50 face each other and move into flat abutment with each other when the venturi sleeves are inserted in the bores of the carburetor body 12. When the positioning cords 50 of adjacent, side-by-side venturi sleeves are in abutment with one another, the venturi sleeves cannot be rotated about their longitudinal axes, but are locked into a nonrotatable position. Moreover, since the slots 52 which are to receive the support conduits of the booster venturis are at the opposite end of the venturi sleeves and are diametrically opposed to the positioning cords, the slots 52 will be required to become aligned with the support conduits of the booster venturis.

As best illustrated in FIG. 4, each venturi sleeve 24–30 has a first or upper end 56, a second or lower end 58, and a wall venturi constriction 60 intermediate ends 56 and 58. The constriction 60 is formed by progressively converging annular inlet surface 62 and annular tapered diverging exhaust surface 64. The wall venturi constriction 60 functions to form a zone of low gas pressure, when gas, such as air, moves along the longitudinal axis 66 of the venturi sleeve, in the conventional manner to induce fuel to enter the venturi sleeve.

A retainer plate 68 (FIG. 3) is mounted to the bottom surface 70 of the carburetor body 12, by threaded screws 72. The retainer plate 68 includes openings 73 which are aligned with the venturi sleeves, so as to permit the free passage of air therethrough. The retainer plate 68 engages the second or lower end 58 of each venturi sleeve in the carburetor body, so that the venturi sleeves are trapped between the internal shoulder 36 of the bores 14–20 and the retainer plate 68.

Booster venturis 74, 76, 78 and 80 are each mounted to the carburetor body 12 and are suspended from the carburetor body in a venturi sleeve 24–30 respectively. As shown in FIG. 4, the carburetor body 12 defines stepped openings 82 which extend from outside the carburetor body inwardly through the side wall of the carburetor and intersect the inside of the carburetor immediately above the bores 14–20. The booster venturis, such as the booster venturis 74 and 76 of FIGS. 3 and 4, each include a ring nozzle 84 and a support conduit 86. The support conduit 86 has a distal end that protrudes into an opening 82 in the side wall of the carburetor body 12, and internally threaded nuts 88 are threaded about the distal ends of the support conduits, from outside the carburetor housing. As the threaded nuts 88 are threaded onto the ends of the support conduits of the booster venturis, the collar 90 formed on the support conduit 86 is drawn into engagement with the interior surface of the carburetor housing 12. The threaded nut 88 is then drawn into the sloped counterbore 94 of the opening 82, so that the nut 88 becomes flush with the external surface of the carburetor body 12. This supports the booster venturi 74 in the manner illustrated in FIG. 3, so that the ring nozzle 84 is concentric with the venturi sleeve of the bore.

The ring nozzle 84 of each booster venturi includes a venturi constriction 96, and a fuel delivery port 98 delivers fuel to the venturi constriction 96 from fuel passageway 100 in the support conduit 86. The side opening or slot 52 (FIGS. 5*a* and 5*b*) of each venturi sleeve partially surrounds the support conduit 86 of each booster venturi, which enables the ring nozzle 84 to be received adjacent the wall venturi constriction 60 of the venturi sleeve. Therefore, the venturi constriction 96 of the booster venturi is axially displaced from the wall constriction 60 of the venturi sleeve, so as to achieve overlapping sequential zones of low pressure within the venturi sleeve in response to the flow of gas downwardly through the carburetor body 12.

As best illustrated in FIG. 2, the carburetor body 12 defines a carburetor bowl 102 that faces the oncoming air that flows through the carburetor. The carburetor bowl 102 is generally concave, and includes an outer perimeter rim 93, a sloped interior side wall 95 intersecting rim 93, and an interior surface 97 merged with side wall 95, all of which form concave flow director surfaces 104, 106, 108 and 110 which substantially surround the bores 14, 16, 18 and 20 respectively. Ridges 105, 107, 109, and 111 extend from the central area 113 where the filter (not shown) is connected, radially between the bores 14–20 and separate the concave flow directors from one another. The circular rims 114, 116, 118 and 120 of the bores 14–20 intersect the carburetor bowl 102, so that the concave flow directors extend to the rims of the bores. When the venturi sleeves 24–30 are telescopically inserted upwardly into the bores 14–20, the first or upper annular edges 56 of the venturi sleeves will be located next adjacent the circular rims 114, 116, 118 and 120, so that the concave flow directors 104, 106, 108 and 110 direct the air in the carburetor bowl toward the venturi sleeves 24–30.

Figure 6:
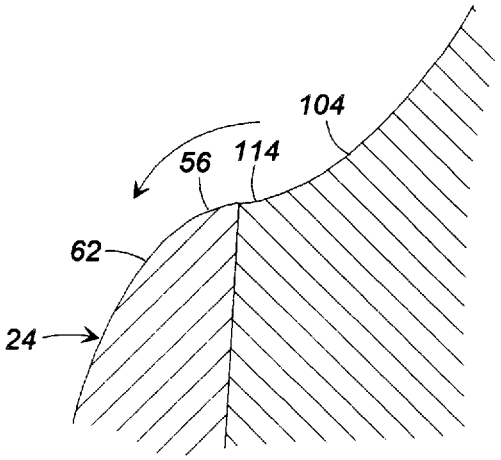
FIG. 6 is a detail of the first edge of a venturi sleeve and the adjacent flow director surface of the carburetor bowl.

FIG. 6 is a detail illustration of the upper, first end of a venturi sleeve, such as venturi sleeve 24, showing the annular inwardly converging surface 62, and how that surface curves to intersect the upper outer cylindrical surface 42 of the venturi sleeve. Concave flow director surface 104 is contoured to follow the shape of the converging surface 62 of the venturi throat and converges toward its circular rim 114 about the venturi sleeve 24, and the surface 104 is in alignment with and substantially coextensive with the surface of the upper, first end 56 of the venturi sleeve 24. This coextensive relationship between the surfaces 104 and 56 functions to induce a smooth flow of air from the concave flow director surfaces 104, 106, 108 and 110 of the carburetor bowl 102 into the venturi sleeves 24, 26, 28 and 30, without requiring the air to negotiate angular surfaces or obstructions. This streamlined contour of the flow director surfaces of the carburetor bowl 102 and the venturi passages through the carburetor tends to reduce the number of changes of direction of the air flow through the carburetor, tends to reduce turbulence in this portion of the carburetor, enhances the air flow efficiency of the carburetor and improves the flow of air about the inlet of the venturi throats. Further, the vent tube boss 122, squirter boss 124 and air bleeds 125, 126, 127 and 128 at diametrically opposite sides of the carburetor bowl have been moved outwardly, as close as practical to the perimeter rim 93 of the carburetor, so as to be substantially out of the way of the air flow moving into the carburetor bowl and about its concave flow director surfaces and venturi passages. This also reduces the obstruction to air flow through the carburetor.

While the drawings illustrate concave flow director surfaces in the carburetor bowl, other shapes can be used to enhance the flow of air from the carburetor bowl to the venturi throats, such as fins, grooves, convex surfaces, ridges, flats, or vanes, or their equivalents, which are aligned in the carburetor bowl so as to smoothly direct the air movement toward the venturi throats. In the preferred embodiment, the intersection of the venturi throat and the carburetor bowl is contoured so as to have the flow director surface of the bowl merge with and be substantially coextensive with the inwardly converging annular surface of the venturi throat, for reducing air turbulence at the entry of the venturi throats.

While a preferred embodiment of the invention has been disclosed in detail in the foregoing description and drawings, it will be understood by those skilled in the art that variations and modifications thereof can be made without departing from the spirit and scope of the invention as set forth in the following claims.

I claim:

1. A carburetor for an internal combustion engine, comprising:

a carburetor body defining four open-ended bores extending therethrough, each of said bores including an upper cylindrical interior portion, a lower cylindrical interior portion of larger diameter than said upper cylindrical interior portion and concentric with said upper interior cylindrical portion, and internal shoulder means joining said upper and lower cylindrical interior portions;

a venturi sleeve removably positioned in each of said bores, said venturi sleeves each having an upper outer cylindrical surface sized and shaped to match the size and shape of said upper cylindrical portion of a bore and a lower outer cylindrical surface sized and shaped to match the size and shape of said lower cylindrical portion of a bore, and external shoulder means joining said upper and lower outer cylindrical surfaces and abutting said internal shoulder means of a bore;

said venturi sleeves each defining an annular internal open ended venturi passage for the flow therethrough of air moving from the atmosphere to an internal combustion engine, said venturi passage having a first end with an annular converging surface, a second end with an annular diverging surface, and an annular wall venturi constriction intermediate its ends constructed of a shape for generating a zone of low pressure at the venturi constriction in response to a flow of air moving through said passage from said first end through said second end;

said carburetor body having an air inlet manifold bowl with said bores intersecting said bowl;

said manifold bowl having an interior surface which defines concave flow director surfaces surrounding and intersecting each of said bores with the flow director surfaces being substantially coextensive with the annular inwardly converging surfaces of said venturi sleeves; and means mounted to said carburetor body for holding said venturi sleeves in said bores.

2. A carburetor for an internal combustion engine, comprising:

a carburetor body defining open-ended parallel bores extending therethrough, a venturi sleeve removably positioned in each of said bores;

said venturi sleeves each defining an annular internal open ended venturi throat for the flow therethrough of air moving from the atmosphere to an internal combustion engine, said venturi throat having a first end with an annular converging surface, a second end with an annular diverging surface, and an annular wall venturi constriction intermediate its ends constructed of a shape for generating a zone of low pressure at the venturi constriction in response to a flow of air moving through said throat from said first end through said second end;

said carburetor body including an air inlet manifold bowl with said bores intersecting said manifold bowl; and said manifold bowl having interior concave flow director surfaces with each concave flow director surface surrounding and intersecting each of said bores, with each concave flow director surface separated from adjacent concave flow director surfaces by ridges extending between said concave flow director surfaces, said flow director surfaces being substantially coextensive with the annular inwardly converging surfaces of said venturi sleeves for substantially improving the flow of air about the first ends of the venturi throats.

3. A carburetor for an internal combustion engine, comprising:

a carburetor body;

said carburetor body including an air inlet bowl;

said carburetor body defining at least two side-by-side parallel annular open-ended venturi throats extending therethrough and intersecting said air inlet bowl for the flow of air moving from the atmosphere through said air inlet bowl through said venturi throats to an internal combustion engine;

said venturi throats each having a first end with an annular converging surface, a second end with an annular diverging surface, and a wall venturi constriction intermediate its ends constructed of a shape for generating a zone of low pressure in response to a flow of air moving from said air inlet bowl through said throats;

said air inlet bowl having interior contoured flow director surfaces, with each interior contoured flow director surface surrounding and intersecting one of said venturi throats, and each flow director surface being substantially coextensive with the annular converging surface of said venturi throat smoothly directing air from the air inlet bowl into the venturi throat.

4. The carburetor of claim 3 wherein each of said flow director surfaces is concave and its concave surface completely surrounds its venturi throat for guiding air from all directions radially about each venturi throat into each venturi throat.

5. The carburetor of claim 3 wherein said venturi throats comprise four venturi throats arranged in a rectangular cluster about a central portion of said inlet bowl and ridges extending radially from said central portion between said venturi throats for separating the flow of air.

6. A carburetor for an internal combustion engine, comprising:

a carburetor body defining a plurality of open-ended bores extending therethrough, and said bores each including an upper cylindrical interior portion, a lower cylindrical interior portion of larger diameter than said upper cylindrical interior portion and concentric with said upper interior cylindrical portion, and an internal shoulder means joining said upper and lower cylindrical interior portions;

a venturi sleeve positioned in each of said bores, said venturi sleeves each having an upper outer cylindrical surface sized and shaped to match the size and shape of an upper cylindrical portion of a bore and a lower outer cylindrical surface sized and shaped to match the size and shape of a lower cylindrical portion of the bore, and external shoulder means joining said upper and lower outer cylindrical surfaces and abutting an internal shoulder means of the bore;

alignment means formed in said lower outer cylindrical surface for engaging and aligning with an adjacent venturi sleeve;

said venturi sleeve defining an annular internal open ended venturi passage for the flow therethrough of air moving from the atmosphere to an internal combustion engine, said venturi passage having a first end, a second end, and a wall venturi constriction intermediate its ends constructed of a shape for generating a zone of low pressure at the venturi constriction in response to a flow of air moving through said passage from said first end through said second end; and means mounted to said carburetor body for holding said venturi sleeve in said bore.

7. The carburetor assembly for an internal combustion engine as set forth in claim 6 and wherein said plurality of open-ended bores comprises four open-ended bores, and wherein said venturi sleeves are positioned in each bore.

8. The carburetor assembly for an internal combustion engine asset for the in claim 7 and wherein said alignment means of said venturi sleeves comprises a positioning cord formed in the lower outer cylindrical surface of each venturi sleeve which is sized and shaped to abut the positioning cord of an adjacent venturi sleeve.

9. The carburetor assembly for an internal combustion engine as set forth in claim 7 and wherein said four open ended bores of said carburetor body are arranged in a rectangular cluster, with the lengths of all of the bores being parallel, and with the bores intersecting at a first one of their ends an air inlet manifold bowl, said bowl having an outer perimeter rim, a sloped interior side wall intersecting said rim, and an interior surface merged with said sloped side wall, said interior surface and said side wall sloped toward and intersecting said bores for guiding air from said manifold bowl smoothly toward said bores.

10. The carburetor assembly for an internal combustion engine as set forth in claim 9 and wherein said sloped side wall and said interior surface define flow separator ridges extending from the center of the cluster of said bores, between said bores and up said sloped side wall.

11. The carburetor assembly for an internal combustion engine as set forth in claim 6, and wherein said venturi sleeve includes a side opening extending therethrough adjacent said first end, a booster venturi having a support conduit mounted at one of its ends to said carburetor body and extending through said side opening of said venturi sleeve, and a ring nozzle mounted to said support conduit and suspended in said venturi passage, said ring nozzle having a venturi constriction ring constructed of a shape for generating a zone of low pressure at its venturi constriction in response to the flow of air moving through said passage; and fuel conduit means for supplying fuel through said booster venturi.

12. The carburetor assembly for an internal combustion engine as set forth in claim 11 and wherein said venturi constriction ring of said booster venturi and said wall venturi constriction of said venturi sleeve are axially offset from each other along the length of said venturi sleeve a distance to form overlapping zones of reduced air pressure.

13. A carburetor assembly for an internal combustion engine comprising:

a carburetor body defining four open ended venturi throats extending therethrough for the movement of air from the atmosphere toward an internal combustion engine, said venturi throats being arranged parallel to each other and in a rectangular cluster in said carburetor body, and each including an annular converging inlet surface;

said carburetor body having an air inlet manifold bowl, with said annular converging inlet surfaces of the venturi throats intersecting said manifold bowl;

said manifold bowl having a perimeter rim and a plurality of concave contoured interior surfaces, each of said concave contoured interior surfaces surrounding one of said venturi throats and coextensive with said annular converging inlet surfaces of said venturi throats for guiding air from said manifold bowl smoothly toward said venturi throats; and ridges extending between said concave contoured interior surfaces separating said concave contoured interior surfaces for smoothly directing air from said air inlet manifold bowl into said concave contoured interior surfaces.

14. The carburetor assembly for an internal combustion engine as set forth in claim 13 and wherein said open ended venturi throats each have a wall venturi constriction formed therein for generating zones of low pressure in response to the flow of air moving through said venturi throats, and further including booster venturis each having a ring nozzle suspended in each of said venturi throats, said ring nozzles each having a venturi constriction ring for generating a zone of low pressure at its constriction in response to the flow of air moving through said venturi throats, said zones of low pressure of said wall venturi constriction and of said ring venturi constriction being displaced form each other along the lengths of the venturi throats a distance to form overlapping zones of reduced air pressure.

15. A venturi sleeve for a carburetor of an internal combustion engine, comprising:

an upper outer cylindrical surface, a lower outer cylindrical surface of a diameter larger than said upper outer cylindrical surface, an external annular shoulder joining said upper and lower cylindrical surfaces, a positioning cord formed in said lower cylindrical surface for engaging a like positioning cord of an adjacent venturi sleeve, an annular internal open ended venturi passage for the flow therethrough of air moving from the atmosphere, through a carburetor, toward an internal combustion engine, and said venturi passage having a first end, a second end and an annular wall venturi constriction intermediate its ends constructed of a shape for generating a zone of low pressure at the venturi constriction in response to a flow of air moving through said passage.

16. The venturi sleeve of claim 15 and further including a side opening formed in said venturi sleeve for receiving a support conduit of a booster venturi.

17. A carburetor for an internal combustion engine, comprising:

a carburetor body defining open ended venturi throats extending therethrough for the movement of air from the atmosphere toward an internal combustion engine, said venturi throats being arranged parallel to each other and in a cluster and each including an annular converging inlet surface;

said carburetor body having an air inlet manifold bowl with contoured interior air flow director surfaces, with said annular converging inlet surfaces of the venturi throats intersecting said air flow director surfaces;

said air inlet manifold bowl including a perimeter rim for supporting an air filter and said contoured interior air flow director surfaces extending between said perimeter rim and each of said venturi throats and defining concave air guide surfaces, with each of said concave air guide surfaces converging toward one of said venturi throats, with each concave air guide surface surrounding a venturi throat and being coextensive with said annular converging inlet surface of its said venturi throat;

so that the air flowing adjacent the concave air guide surfaces of the inlet manifold bowl into the venturi throats tends to follow the concave guide surfaces of said manifold bowl toward the annular converging inlet surfaces of the venturi throats substantially without an abrupt change of direction.

18. The carburetor of claim 17, wherein:

said carburetor body defines parallel bores therethrough, and venturi sleeves are inserted into said bores and form said open ended venturi throats.

19. The carburetor of claim 17, wherein:

said concave air guide surfaces being separated from each other by ridges formed in said manifold bowl and extending between said venturi throats.

* * * * *